US008001648B2

(12) United States Patent
Gueret

(10) Patent No.: US 8,001,648 B2
(45) Date of Patent: Aug. 23, 2011

(54) DEVICE FOR CLEANSING THE SKIN, A KIT INCLUDING SUCH A DEVICE, A METHOD OF MAKING SUCH A DEVICE AND A METHOD OF USING SUCH A DEVICE

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 690 days.

(21) Appl. No.: 11/521,471

(22) Filed: Sep. 15, 2006

(65) Prior Publication Data

US 2007/0061990 A1 Mar. 22, 2007

Related U.S. Application Data

(60) Provisional application No. 60/723,449, filed on Oct. 5, 2005.

(30) Foreign Application Priority Data

Sep. 16, 2005 (FR) ..... 05 52801

(51) Int. Cl.
*A47K 7/02* (2006.01)

(52) U.S. Cl. ..... 15/244.3; 15/209.1; 15/210.1

(58) Field of Classification Search ..... 15/104.001, 15/244.3, 209.1, 210.1, 142, 245, 236.08, 15/236.01, 188; 606/289
See application file for complete search history.

(56) References Cited

U.S. PATENT DOCUMENTS

| | | | | |
|---|---|---|---|---|
| 1,817,585 | A | 8/1931 | Samuel | |
| 2,829,393 | A * | 4/1958 | Turcotte et al. | 401/207 |
| 4,483,636 | A * | 11/1984 | Meyer | 401/266 |
| 5,123,431 | A * | 6/1992 | Wilson | 132/320 |
| 5,655,257 | A | 8/1997 | Chavez | |
| 5,664,281 | A * | 9/1997 | Pelfrey | 15/244.2 |
| 5,671,498 | A | 9/1997 | Martin et al. | |
| 5,673,455 | A * | 10/1997 | Per-Lee et al. | 15/210.1 |
| 5,931,591 | A * | 8/1999 | McCracken | 401/6 |
| 2006/0210774 | A1 * | 9/2006 | Linzell | 428/174 |

FOREIGN PATENT DOCUMENTS

| | | | |
|---|---|---|---|
| EP | 0 829 201 | A1 | 3/1998 |
| GB | 2 338 648 | A | 12/1999 |
| WO | WO 2004/057999 | A1 | 7/2004 |

* cited by examiner

*Primary Examiner* — Dung Van Nguyen
(74) *Attorney, Agent, or Firm* — Oliff & Berridge, PLC

(57) ABSTRACT

A skin cleanser device may include a cleanser member including a cleanser surface configured to be moved in contact with skin. The cleanser surface may be defined by an elastically deformable synthetic material other than a foam, and may include cavities that include undercuts.

21 Claims, 8 Drawing Sheets

DEVICE FOR CLEANSING THE SKIN, A KIT INCLUDING SUCH A DEVICE, A METHOD OF MAKING SUCH A DEVICE AND A METHOD OF USING SUCH A DEVICE

This non provisional application claims the benefit of French Application No. 05 52801 filed on Sep. 16, 2005 and U.S. Provisional Application No. 60/723,449 filed on Oct. 5, 2005, the entire disclosures of which are incorporated herein by reference.

The present invention relates to a device for cleansing skin, in particular, one that includes a cleanser surface configured to be moved in contact with the skin.

BACKGROUND

Numerous skin cleanser devices are known.

Some, such as stones surrounded by cords or massage gloves, for example, are relatively aggressive and liable to accumulate dirt, which is unhygienic.

In addition, removing certain film-generating cosmetic compositions may require mechanical action, which should be exerted without irritating the skin, wherever possible.

U.S. Pat. No. 5,671,498 describes a cleanser device in which a cleanser surface is defined by a foam.

SUMMARY

There exists a need to benefit from a cleanser device that is not too aggressive against the skin, that is hygienic, and that is suitable for removing dead skin cells and/or a composition that has been applied to the face or to the body, for example. It may be relatively difficult to obtain foam with such desired abrasion characteristics.

Thus, there also exists a need to make it possible, in a reproducible manner, to obtain a cleanser surface including looked-for abrasion characteristics.

Exemplary embodiments of the invention may provide a skin cleanser device comprising a cleanser member including a cleanser surface configured to be moved in contact with the skin.

In exemplary embodiments, the cleanser member may comprise an elastically deformable synthetic material other than a foam that defines the cleanser surface. Further, the cleanser surface may comprise cavities including undercuts.

In exemplary embodiments, a plurality of cavities may thus each include at least one undercut. The cleanser surface may also comprise cavities without any undercut (re-entrant angles).

In exemplary embodiments, a user may benefit from a cleanser device that is hygienic, because it employs a synthetic material that may be washable.

In addition, the cavities may be made by molding, which may ensure that the cleanser surface may be reproducible.

Finally, using elastically deformable material may make it possible to ensure that the cleanser surface is not too aggressive against the skin.

The presence of undercut surfaces in the cavities may also be possible by using elastically-deformable material, which material may advantageously make it possible to reproduce the imprint of an abrasive surface.

In exemplary embodiments, the cavities may be distributed in a non-uniform manner over the cleanser surface, and/or may include shapes that are different.

A largest dimension of the cavities may be less than or equal to 5 millimeters (mm), for example, less than or equal to 2 mm.

The cleanser surface may be defined by an elastically deformable membrane of the cleanser member, which may impart greater comfort in use and may augment treatment possibilities, for example, because of an increased deformability of the cleanser surface.

A periphery of the cleanser member, for example, of the membrane, may be secured to a frame of a handle. This may enable the user to exert pressure on the cleanser member by pressing thereagainst, for example, through the frame, from a side thereof opposite from the cleanser surface.

The cleanser member, for example, the membrane, may include a finger on the side opposite from the cleanser surface, and the user may press against the finger to deform the cleanser surface.

In exemplary embodiments, the device may include a handle that is bent, thereby making the handle more ergonomic to use, for example.

In exemplary embodiments, the cleanser member may be removable, which may make it easier to cleanse and/or may enable the user to use a common handle member of the cleanser device in association with a plurality of cleanser members including characteristics that are different, for example, different surface states and/or different shapes.

The cleanser device may comprise a handle member, for example, in the form of an elongate handle, and the cleanser member may comprise a support part configured to support the elastically deformable material that defines the cleanser surface. The support part may be configured to be secured in a removable manner on the handle member.

The cleanser member may also be overmolded on the handle.

The support part may be of a material that is more rigid than the material that defines the cleanser surface.

For example, the support part may be a ring.

At rest, the cleanser surface may include a shape that bulges.

The cleanser device may also comprise a massage member. The cleanser member and the massage member may be situated at opposite ends of a handle, for example.

In exemplary embodiments, the cleanser member may be secured to a lid for closing a receptacle. When appropriate or desired, the receptacle may contain a cosmetic or dermatological composition, for example, a film-forming composition, which, for removal, may require mechanical action to be exerted by the cleanser member.

The lid may be used as a handle member to hold an applying member, when appropriate or desired.

Exemplary embodiments of the invention may provide a kit comprising: a receptacle containing a composition to apply, for example, a film-forming composition; a cleanser member secured to a lid for closing the receptacle; and an applying member configured to apply the composition, and secured to the lid or the receptacle.

In the absence of any applying member, the user may use his hand or a finger, for example.

Exemplary embodiments of the invention may provide a kit comprising: a handle member; and at least two different surfaces designed to come into contact with the skin and corresponding to cleanser and/or massage and/or applicator members configured to be mounted in an interchangeable manner on the handle member, at least one of the surfaces being defined by an elastically-deformable synthetic material other than a foam and comprising cavities including undercuts.

Exemplary embodiments of the invention may provide a method of making a cleanser surface for cleansing the skin, comprising: making an imprint of an abrasive surface; making a mold of the imprint; and molding an elastically-deformable synthetic material other than a foam in contact with the mold, so as to make the cleanser surface.

Exemplary embodiments of the invention may provide a method of treating skin, for example, cosmetically, the method comprising: applying to the skin a composition, for example, a film-generating composition; and removing the composition using a cleanser device, for example, as defined above.

BRIEF DESCRIPTION OF THE DRAWINGS

Various details of the present invention may will be better understood on reading the following detailed description of non-limiting embodiments, and on examining the accompanying drawings, in which.

DETAILED DESCRIPTION OF EMBODIMENTS

Figure 1:
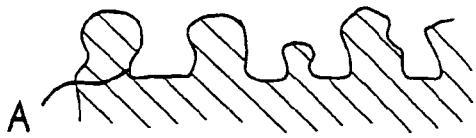
FIGS. 1 to 6 are diagrammatic views illustrating steps in an exemplary method that enables a skin-cleanser surface to be made.

FIG. 1 is a diagrammatic view on an enlarged scale illustrating an abrasive surface A, for example, as defined by sandpaper or by a surface of a material including grains secured by a binder, for example, by a cement.

Figure 2:
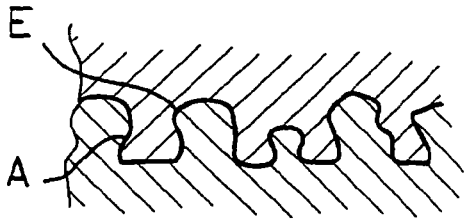

An imprint E may be made of the abrasive surface A, as illustrated in FIG. 2, for example, by an elastomer, such as a silicone polymer, for example.

Figure 3:
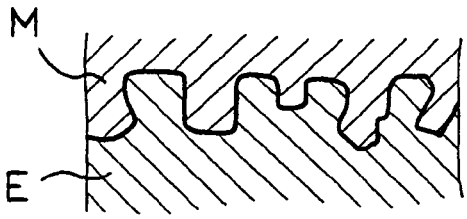

This imprint may be subsequently used to make a mold M, as illustrated in FIG. 3.

Figure 4:
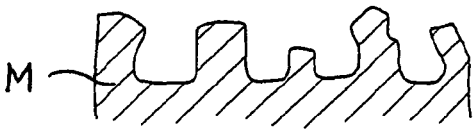

The mold M may include a surface that substantially reproduces a roughness of the abrasive surface A, as illustrated in FIG. 4.

Figure 5:
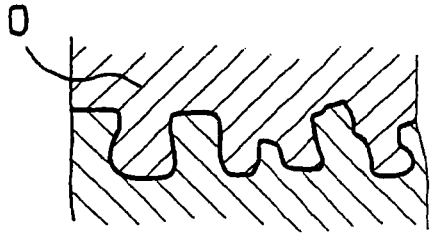
Figure 6:
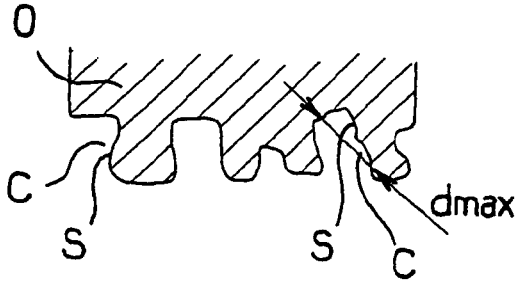

An elastically-deformable synthetic material of a cleanser member may be molded in contact with the mold M, as illustrated in FIG. 5, and after unmolding, the elastically-deformable material may include cavities C that include surfaces S that are undercut, as illustrated in FIG. 6.

For example, the elastically-deformable synthetic material may be a thermoplastic or vulcanizable elastomer, for example, a silicone polymer, an ethylene propylene diene monomer (EPDM) rubber, a latex, a polyurethane elastomer, polyethylene, polyether, polystyrene, polyvinyl acetate (PVA), polyvinyl chloride (PVC), styrene ethylene styrene (SES), or styrene ethylene butylene styrene (SEBS), this list not being limiting.

This elastomer material may be different from a foam including cells that are open, semi-open, or closed.

Dimensions of the cavities C may depend on the dimensions of the original abrasive surface A, as may the distribution of these cavities, which may be uniform or non-uniform.

A maximum dimension dmax of the cavities C may be less than or equal to 5 mm, or even 2 mm, for example.

Figure 7:
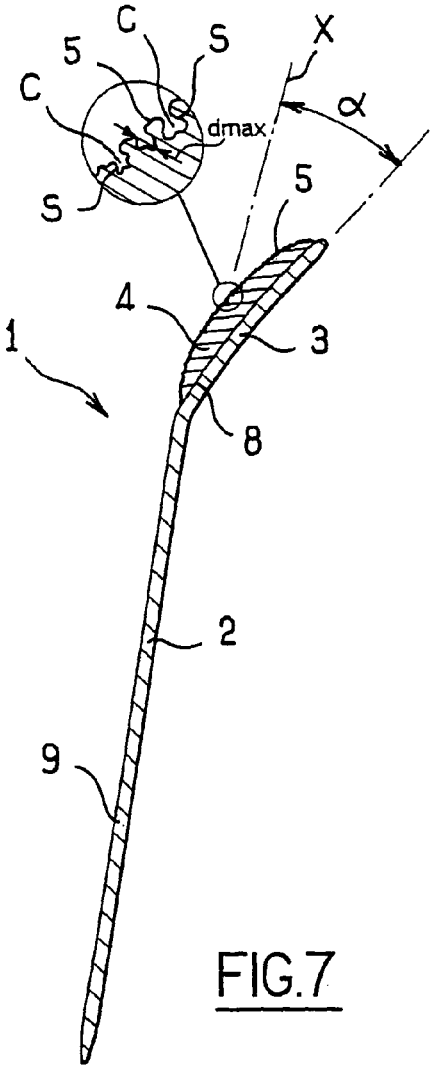
FIG. 7 is a longitudinal cross-sectional view of an exemplary cleanser device.
Figure 8:
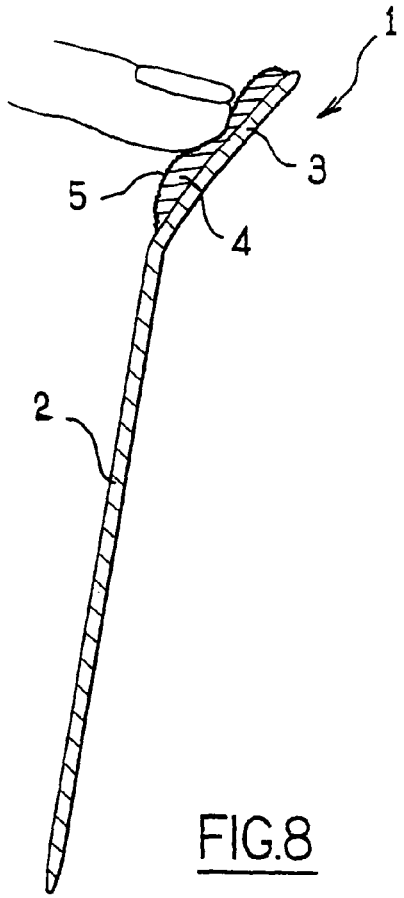
FIG. 8 illustrates deformability of the cleanser surface of the device of FIG. 7.

FIGS. 7 and 8 illustrate an exemplary skin cleanser device 1 comprising a handle 2 with a head 3 provided with a skin cleanser member 4.

The cleanser member 4 may include a surface 5 that may be used for cleansing the skin and that may have been molded in contact with a mold M reproducing a relief of an abrasive surface A, as described above.

The cavities C of the cleanser surface 5 may thus include undercut surfaces S, as illustrated diagrammatically in FIG. 7.

In the example illustrated in FIG. 7, the cleanser member 4 may be solid and may be secured to a face 8 of the head 3 making an angle a with the longitudinal axis X of the handle-forming body 9 of the handle 2. The cleanser surface 5 may lie on a same side as the axis X, which may improve ergonomic cleansing, for example, of the face.

For example, the cleanser member 4 may be stuck to the face 8. Alternatively, the cleanser member 4 may be secured in some other way, for example, by heat-sealing, overmolding, or mechanical fastening, such as screw fastening, snap-fastening, or fastening by hooks and loops of the Velcro® type.

The cleanser-member elastomer material that defines the cleanser surface 5 may be advantageously selected in such a manner as to include sufficient flexibility to enable the user to deform the cleanser surface 5 by exerting moderate pressure with a finger, as illustrated in FIG. 8.

The cleanser surface 5 may include a shape that may be generally bulging, being substantially spherical or ellipsoidal, for example.

Figure 9:
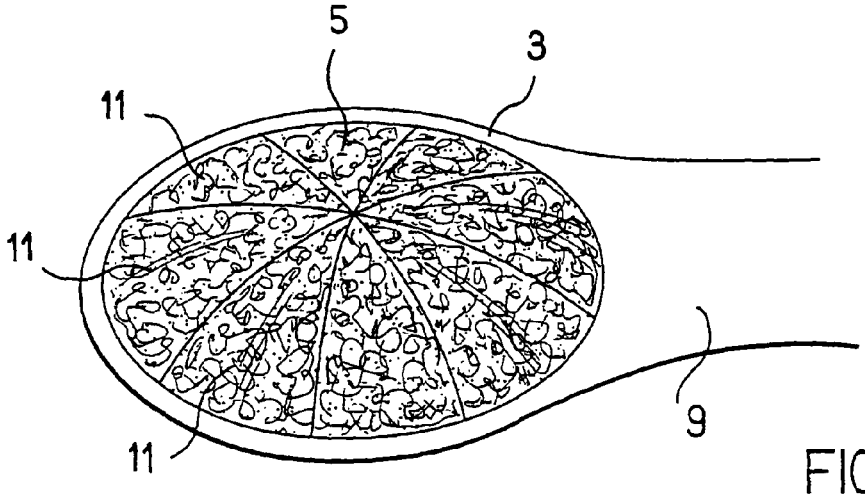
FIG. 9 is a diagrammatic and fragmentary perspective view illustrating an exemplary cleanser surface.
Figure 11:
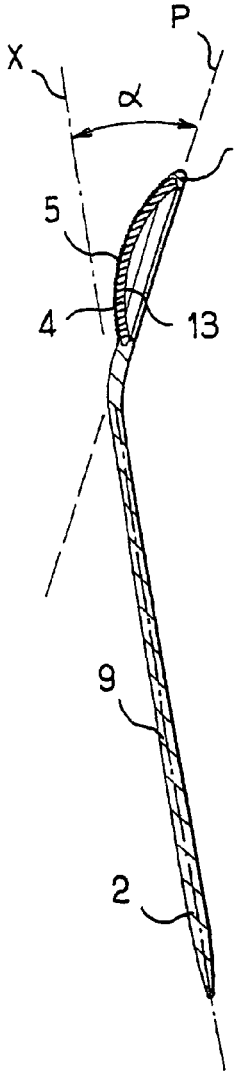
FIG. 11 is a longitudinal cross-sectional view taken along XI-XI of FIG. 10.
Figure 10:
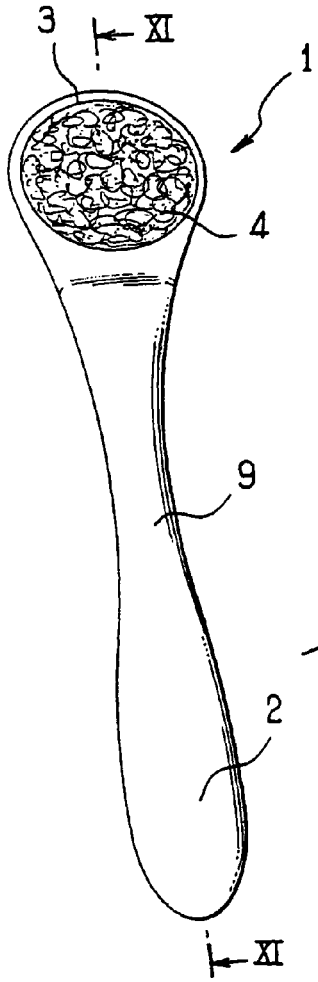
FIG. 10 is a face view of another exemplary embodiment.

The cleanser surface 5 may also include facets 11, as illustrated in FIG. 9.

The entire cleanser surface 5 may include substantially a same roughness, or the cleanser surface 5 may include regions including different properties, for example, different roughnesses.

Thus, for example, the facets 11 illustrated in FIG. 9 may include a same roughness or different roughnesses. When appropriate or desired, this may enable the user to select a region of the cleanser surface that includes the roughness and/or a relief that corresponds to the treatment that is to be performed, for example, exfoliation or removing a deposit of composition.

As illustrated in FIGS. 7 and 8, the head 3 and the handle may not be perforated. Alternatively, the head 3 may be perforated so as to form a frame, as illustrated in FIGS. 10 to 13, for example.

Figure 13:
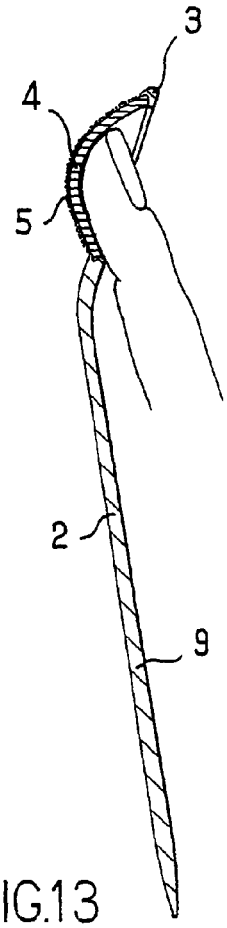

The cleanser member 4 may then be in the form of a membrane secured at a periphery thereof to the frame 3, and, when appropriate or desired, the user may press against the face 13 of the membrane that may be situated opposite from the cleanser surface 5 to deform the membrane, and, for example, to stretch the membrane so as to change an extent of contact between the cleanser surface 5 and the skin, or to apply greater pressure against the skin, as illustrated in FIG. 13.

Figure 12:
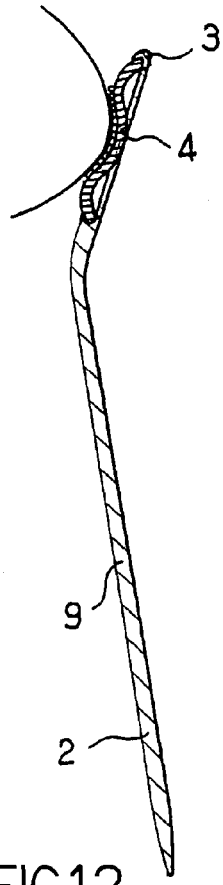
FIGS. 12 and 13 illustrate deformability of the membrane of the device of FIGS. 10 and 11.

Advantageously, the flexibility of the membrane 4 may enable the membrane 4 to deform in contact with regions of the body or the face that are to be treated, as illustrated in FIG. 12.

Figure 14:
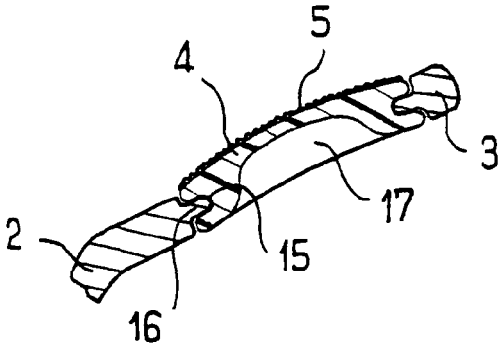
FIG. 14 is a diagrammatic and fragmentary longitudinal cross-sectional view illustrating another way of mounting the cleanser member on the handle.

When the cleanser member 4 is secured to the handle 2 by snap-fastening, as illustrated in FIG. 14, the periphery of the cleanser member 4 may include an annular groove 15 configured to snap onto an annular bead 16 of the frame 3.

As illustrated in FIG. 14, the cleanser member 4 may be made with a recess 17 on a side opposite from the cleanser surface. Alternatively, the cleanser member 4 may be made without such a recess, as illustrated in FIG. 15.

Figure 16:
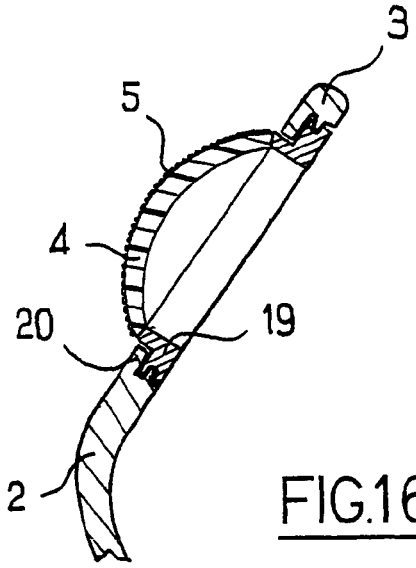
FIGS. 16 to 18 are fragmentary and diagrammatic longitudinal cross-sectional views of exemplary cleanser devices.

The cleanser member 4 may be made as a single piece of elastomer material, or may include a support part configured to support the elastomer material and comprising a material that is more rigid, as illustrated in FIG. 16.

For example, the cleanser surface 5 may be made by injecting two materials to define a membrane that is itself integral, i.e., monolithic with a support ring 19 that may be configured to be fastened to the frame 3, in a removable manner, when appropriate or desired. The support ring 19 may bear against a rim 20 of the frame.

Figure 15:
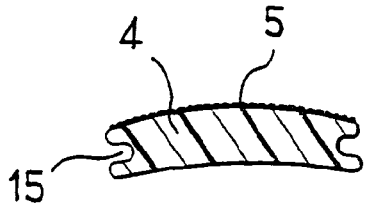
FIG. 15 is a diagrammatic axial cross-sectional view illustrating, in isolation, another exemplary cleanser member suitable for use in the device of FIG. 14.
Figure 17:
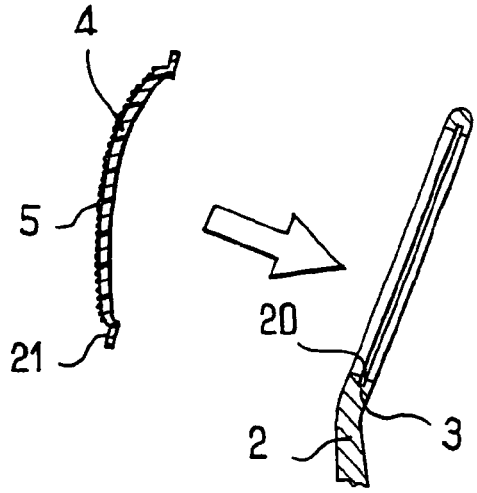

As illustrated in FIG. 17, the cleanser member 4 may be secured directly to the frame 3 by snap-fastening in a manner other than that illustrated in FIGS. 14 and 15, with the frame 3, for example, including an annular groove 20 in which a rim 21 formed on the periphery of the cleanser member 4 may be engaged.

Figure 18:
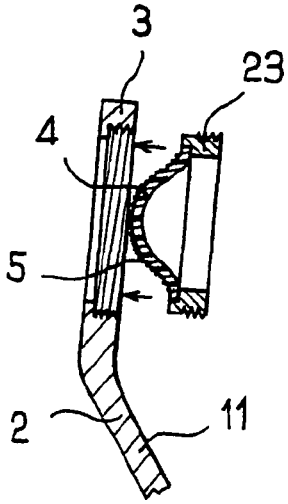

FIG. 18 illustrates another way of fastening the cleanser member 4 to the frame 3. As illustrated, the cleanser member 4 may comprise an elastomer membrane that defines the cleanser surface 5 and is secured at a periphery thereof to a ring 23 configured to be screwed into the frame 3.

Figure 19:
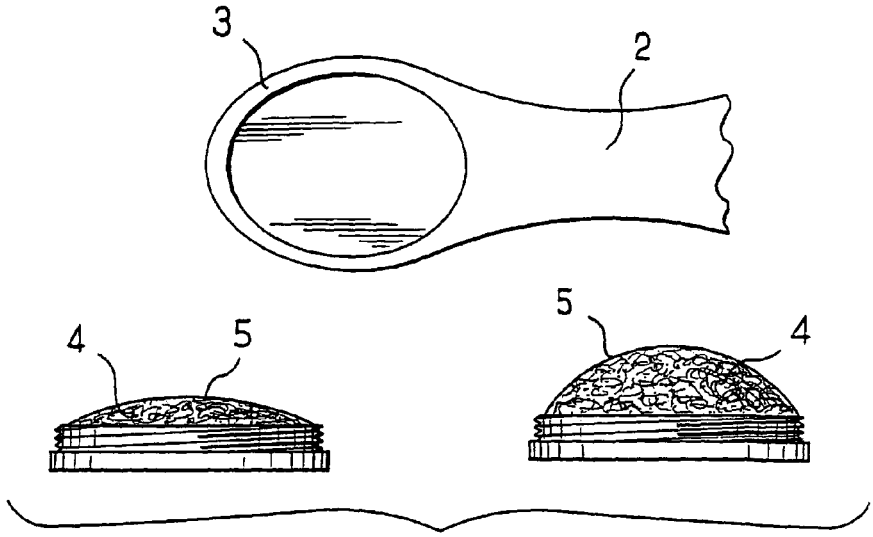
FIGS. 19 and 20 illustrate exemplary kits.
Figure 20:
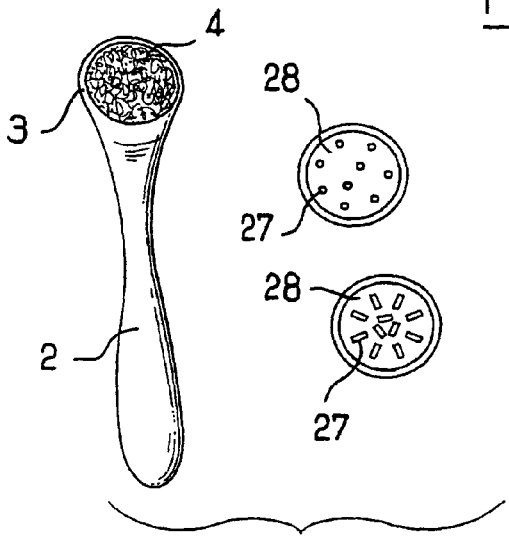

This releasable connection of the cleanser member 4 to the handle 2 may enable the user to benefit from a plurality of cleanser members 4 including different cleanser surfaces 5, as illustrated in FIG. 19.

The user may thus select a particular one of the cleanser members 4 as a function of the treatment that is to be performed.

When appropriate or desired, a handle 2 may be provided that has one or more different cleanser members 4, optionally together with one or more massage members 28, and/or applicator members configured to be secured to the frame 3 and suitable for including portions in relief 27, such as spikes configured to massage the skin on coming into contact therewith.

Figure 21:
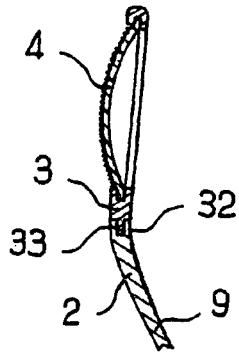
FIG. 21 illustrates another way of mounting the cleanser member on the handle.

FIG. 21 illustrates the cleanser member 4 being permanently secured to the head 3 of the handle, and the head being releasably secured to the handle-forming body 9, for example, by complementary portions in relief 32 and 33 belonging respectively (corresponding) to the head 3 and to the body 9, and configured to co-operate by snap-fastening or screw fastening, for example.

Figure 22:
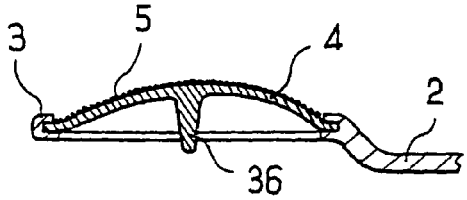
FIG. 22 is a fragmentary and diagrammatic longitudinal cross-sectional view of another exemplary cleanser device.
Figure 23:
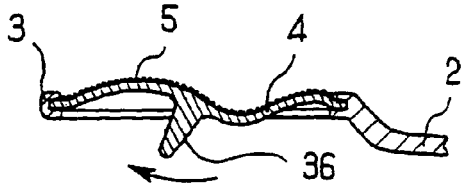
FIG. 23 illustrates deformation of the cleanser surface of the device of FIG. 22.

The cleanser member 4 may include a finger 36 on a side remote from the cleanser surface 5, as illustrated in FIGS. 22 and 23. The finger 36 may optionally be centered, but alternatively may be off center.

The user may press axially against the finger 36 to stretch the cleanser member 4 and deform the cleanser surface 5. The user may also press laterally against the finger 36 to deform the cleanser surface 5, for example, to form at least one corrugation therein, as illustrated in FIG. 23.

Figure 24:
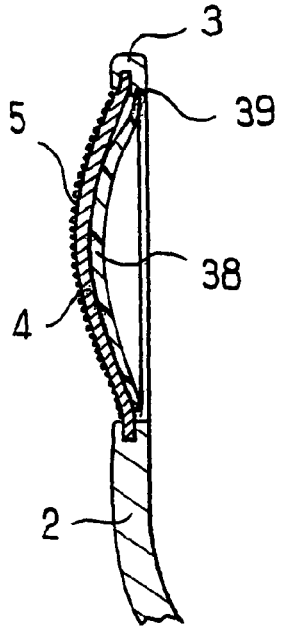
FIG. 24 is a longitudinal cross-sectional view of another exemplary cleanser device.
Figure 25:
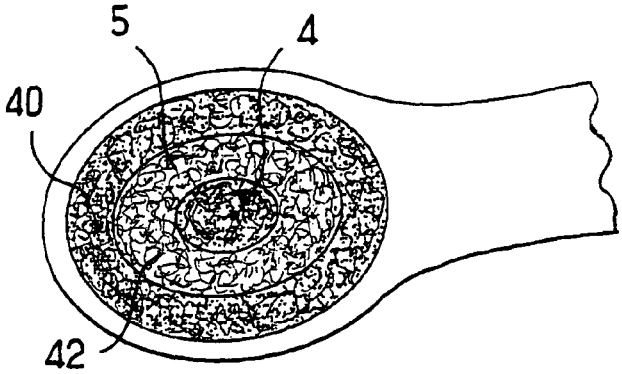
FIG. 25 is a face view of another exemplary embodiment.

When the cleanser member 4 is secured on a frame 3, the user may optionally press directly against the face 13 that is remote from the cleanser surface 5 using the user's own finger, or as illustrated in FIG. 24, using an intermediate part 38 made integrally, i.e., monolithically with the handle 2 and connected thereto via a film-hinge 39, for example.

The cleanser surface 5 may include a variety of arrangements, and, for example, cavities formed using the method described with reference to FIGS. 1 to 6 may extend in concentric regions 40 to 42, with all the cavities in any one region including characteristics that are substantially the same, for example.

Figure 26:
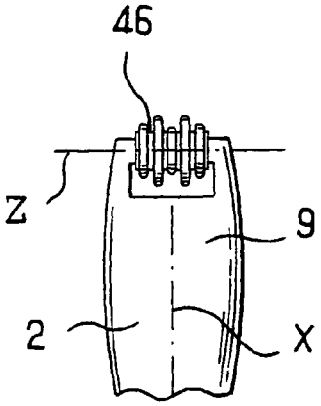
FIG. 26 illustrates an exemplary cleanser device with a massage member.

In any of the examples described above and as illustrated in FIG. 26, the handle 2 may be provided with a massage member 46, which member may, for example, be mounted to rotate about an axis of rotation Z that may be perpendicular to the longitudinal axis X of the body 9, for example.

Figure 27:
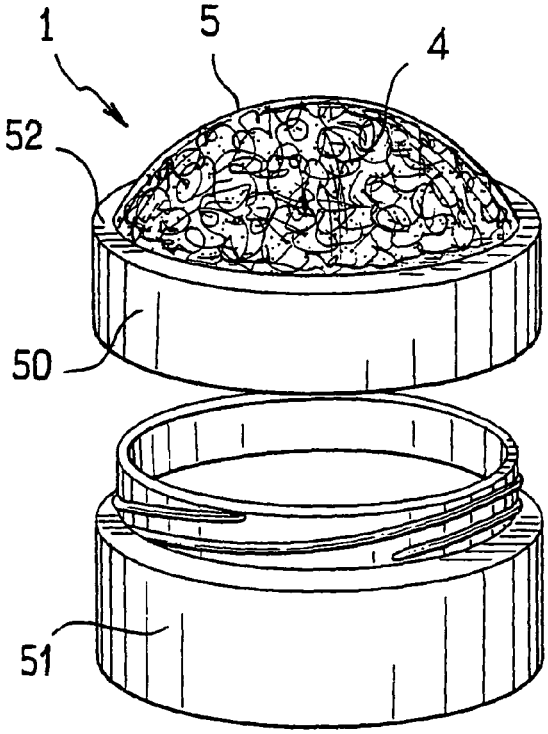
FIGS. 27 to 33 illustrate diagrammatically, in longitudinal cross-section, exemplary cleanser kits.

Instead of being secured to a handle 2, the cleanser surface 5 may also be secured to a lid 50 for closing a receptacle 51, for example, a receptacle containing a film-forming composition for application to the skin. For example, the massage surface 5 may be defined by a massage member 4 that may be secured to the top 52 of the lid 50, as illustrated in FIG. 27.

The user may separate the lid 50 from receptacle 51 to remove the composition and apply the composition, so as to form a mask.

Once the mask has acted, the user may make use of the receptacle 51 as a handle member while the lid 50 is in place, to remove the mask by rubbing the skin against the cleanser member 4.

The applying of the composition may be achieved in several ways, using the hand, the finger or an applying member, which may be free from the receptacle containing the composition or from the lid for closing the receptacle, or may be secured to one of them, at least during the applying of the composition. The applying member may be, when appropriate or desired, secured to the cleanser member 4 at least during the applying of the composition.

Figure 28:
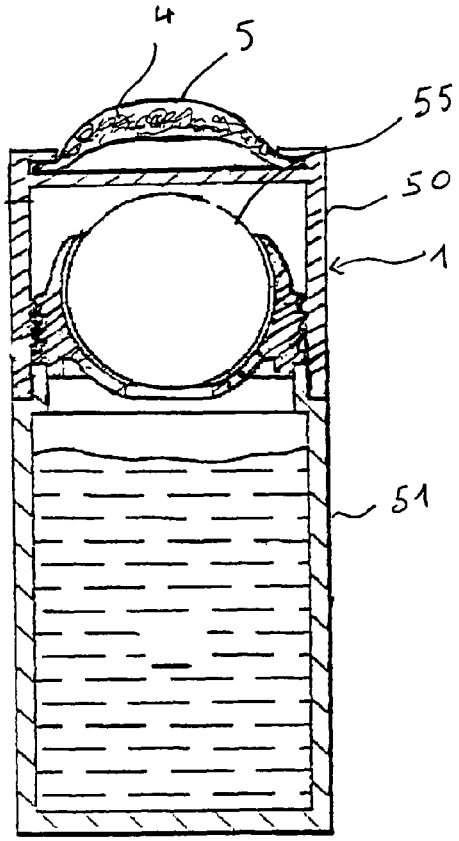

FIG. 28 illustrates an exemplary kit for conditioning and applying, wherein the applying member may be secured to the receptacle containing the composition and may be in the form of a ball. In such an example, the cleanser member 4 may be, for example, fastened to the lid of the receptacle.

Figure 29:
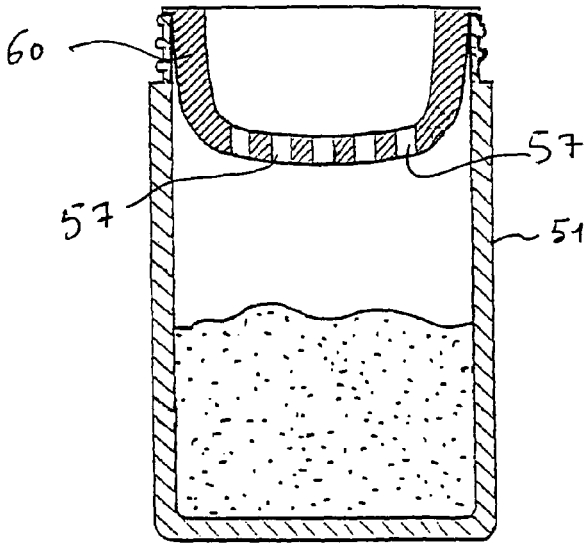

As illustrated in FIG. 29, the applying member may be secured to the lid 50 for closing the receptacle, being, for example, located to the opposite of the cleanser member 4 so as to bear against a seat 60 of the receptacle when the lid 50 is in place.

The seat 60 may be provided with one or several apertures 57 which allow loading with the composition the housing receiving the applying member 55. The latter may comprise, for example, a foam or a sintered material or any other element that enables retention of the composition at least at the surface thereof.

Figure 30:
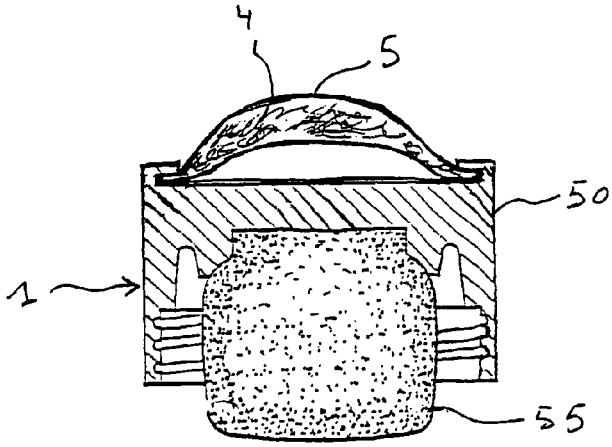
Figure 30:
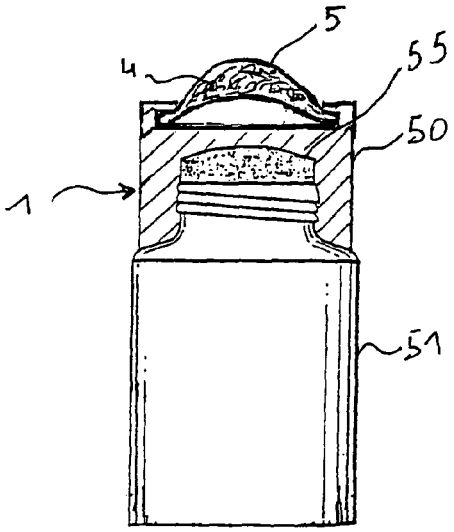

As illustrated in FIG. 30, the applying member 55 may be secured to the receptacle during the application, comprising, for example, a foam or a sintered material or any other permeable element that extends from the receptacle's neck at least when the lid 50 is removed.

Feeding of the applying member 55 may be achieved, for example, by capillarity or by gravity when the receptacle is turned over, or by an overpressure created by pressing against a receptacle's 51 wall.

Figure 31:
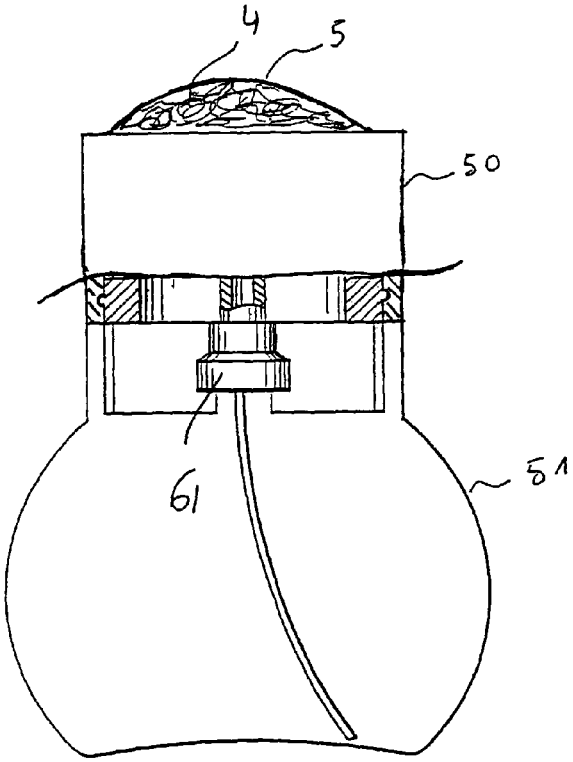

The substance may also be supplied to the applying member by a pump 61, as illustrated in FIG. 31.

A pump may also be used without any applying member, the user taking a sample directly at a pump outlet and applying the sample, for example, by a finger or hand onto the area to be treated.

Figure 32:
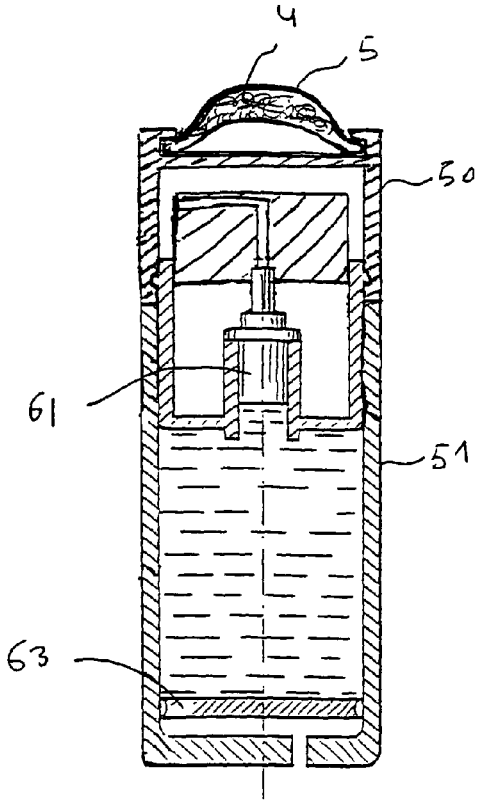

As illustrated in FIG. 32, the pump 61 may be associated to a movable piston 63, with the composition being taken without air intake, for example.

Figure 33:
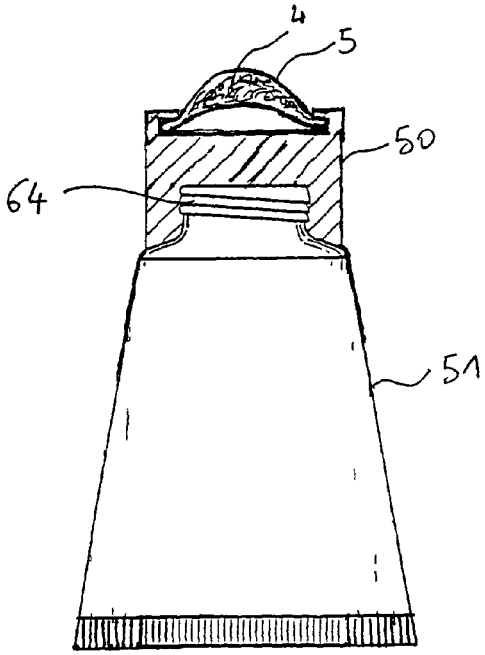

As illustrated in FIG. 33, the receptacle 51 may be a tube and the composition may be, for example, supplied directly through a neck 64 of the tube without any applying member.

In any of the examples of FIGS. 27 to 33 inter alia, the cleanser member 4 may be different, being, for example, fastened in a removable manner on the lid 50. The cleanser member 4 may include other shapes, with, for example, at least two facets including different roughnesses.

The invention is not limited to the examples described above, which features may be combined within various exemplary embodiments that are not specifically illustrated.

For example, the cleanser device may be provided with a vibrator.

The term "comprising a" should be understood as being synonymous with "comprising at least one" unless specified to the contrary.

Although various details of the present invention herein have been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

What is claimed is:

1. A skin cleanser device comprising a cleanser member including a cleanser surface configured to be moved in contact with skin, the cleanser surface being defined by an elastically-deformable synthetic material other than a foam and comprising protrusions on a face of the cleanser member which define cavities that include undercuts, the protrusions being made in the elastically-deformable synthetic material and being solid.

2. A device according to claim 1, wherein the cavities include shapes that are different.

3. A device according to claim 1, wherein the cleanser surface reproduces an imprint of an abrasive surface.

4. A device according to claim 1, wherein a largest dimension of the cavities is not greater than 5 mm.

5. A device according to claim 1, wherein the cleanser surface is defined by an elastically-deformable membrane of the cleanser member.

6. A device according to claim 5, wherein the membrane includes a periphery at which the membrane is secured to a frame of a handle.

7. A device according to claim 6, wherein the cleanser member comprises a side opposite from the cleanser surface, the opposite side being configured to allow a user to press to deform the cleanser surface.

8. A device according to claim 1, wherein the cleanser member is overmolded on a handle.

9. A device according to claim 1, further comprising a bent handle.

10. A device according to claim 1, wherein the cleanser member is removable.

11. A device according to claim 1, further comprising a handle member, wherein the cleanser member comprises a support part configured to support the elastically-deformable synthetic material that defines the cleanser surface, and configured to be secured in a removable manner on the handle member.

12. A device according to claim 1, wherein the cleanser surface at rest includes a bulging shape.

13. A device according to claim 1, further comprising a massage member.

14. A device according to claim 13, further comprising a handle including opposite ends, wherein the cleanser member and the massage member are situated at the opposite ends of the handle.

15. A device according to claim 1, wherein the cleanser member is secured to a lid for closing a receptacle.

16. A method of cosmetically treating skin using a skin cleanser device according to claim 1, comprising:

applying to the skin a composition; and removing the composition using the cleanser device.

17. A method according to claim 16, further comprising securing the cleanser member to a receptacle containing the composition, at least when the receptacle is closed.

18. A method according to claim 16, wherein applying the composition comprises applying to the skin a film-generating composition.

19. A skin cleanser device comprising a cleanser member including a cleanser surface configured to be moved in contact with skin, the cleanser surface being defined by an elastically-deformable synthetic material other than a foam and comprising protrusions on a face of the cleanser member which define cavities that include undercuts, the cavities being at least one of distributed in a non-uniform manner over the cleanser surface; and having shapes that are different.

20. A kit comprising:

a handle member; and at least two different surfaces designed to come into contact with skin and corresponding to at least one of a cleanser member, a massage member and an applicator member, the at least one of the cleanser member, the massage member and the applicator member being configured to be mounted in an interchangeable manner on the handle member, at least one of the surfaces being defined by an elastically-deformable synthetic material other than a foam and comprising protrusions on a face of the cleanser member which define cavities including undercuts, the protrusions being made in said elastically-deformable synthetic material and being solid.

21. A method of making a cleanser surface for cleansing the skin, comprising:

making an imprint of an abrasive surface;

making a mold of the imprint; and molding an elastically-deformable synthetic material other than a foam in contact with the mold, so as to make the cleanser surface, the cleanser surface comprising protrusions that define undercuts, the protrusions being made in the elastically-deformable synthetic material and being solid.

* * * * *